US006683576B2

(12) United States Patent
Achim

(10) Patent No.: US 6,683,576 B2
(45) Date of Patent: Jan. 27, 2004

(54) CIRCUIT BOARD AND SMD ANTENNA

(75) Inventor: Hilgers Achim, Alsdorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/234,799

(22) Filed: Sep. 4, 2002

(65) Prior Publication Data

US 2003/0043081 A1 Mar. 6, 2003

(30) Foreign Application Priority Data

Sep. 4, 2001 (DE) ..... 101 43 168

(51) Int. Cl.[7] ..... H01Q 1/24; H01Q 1/38
(52) U.S. Cl. ..... 343/702; 343/700 MS
(58) Field of Search ..... 343/702, 700 MS

(56) References Cited

U.S. PATENT DOCUMENTS 5,969,680 A * 10/1999 Tsuru et al. ..... 343/700 MS

FOREIGN PATENT DOCUMENTS

EP 0790662 A1 8/1997 ..... H01Q/1/24

* cited by examiner

*Primary Examiner*—Michael C. Wimer
(74) *Attorney, Agent, or Firm*—Gregory L. Thorne

(57) ABSTRACT

A printed circuit board (4) is described for surface mounting of electrical and/or electronic components, in particular an SMD (surface mounted device) antenna with a ceramic substrate (1) and at least one resonant track structure (20; 30), and such an antenna for single and multiband applications, in particular in the high-frequency and microwave range. Since one end of the track structure (20) of the antenna is connected to the ground metallization (41), a relatively large bandwidth is achieved with small dimensions of the antenna plus the possibility of smaller board design.

7 Claims, 2 Drawing Sheets

CIRCUIT BOARD AND SMD ANTENNA

The invention relates to a printed circuit board (PCB) for surface mounting of electrical and/or electronic components, in particular an SMD (surface mounted device) antenna with a ceramic substrate and at least one resonant conductor track structure. The invention also relates to such an antenna for single and multiband applications, in particular in the high-frequency and microwave ranges.

Electromagnetic waves in the high-frequency and microwave range are used for transmitting information in mobile communications. Examples of this are the mobile phone bands which lie in the range between approx. 880 and 960 MHz (GSM 900) and between approximately 1710 and 1880 MHz (DCS 1800) and around 1850 and 1990 MHz (PCS 1900) in Europe, the GPS navigation signals which are emitted in a frequency band at approximately 1573 MHz, and the Bluetooth band in the frequency range between approximately 2400 MHz and 2500 MHz which is used for data exchange between individual terminals. Thus firstly a strong trend can be detected towards miniaturization of communication devices and their components and secondly the aim is to equip these devices with more and more functions (multifunctional devices). This concerns, for example, mobile phones which are combined with a receiver module for GPS navigation signals and a Bluetooth module for data communication with other terminals.

The generally accepted surface mounting (SMD method) of the electronic components on the printed circuit board (PCB) and the increasing integration of individual modules do indeed achieve a good degree of miniaturization. An essential problem in relation to further miniaturization is, however, the space required for the components and in particular the antennae, as the latter must have a particular minimum size in order to form an electromagnetic resonance, in general a length of at least one quarter of the wavelength of the radiation emitted. This problem can be partially solved by the use of a dielectric carrier material (substrate) with as high a dielectric constant $\in$ as possible, because then the wavelength in the substrate is reduced by a factor $1/\sqrt{\in}$ and a corresponding reduction in dimensions of antenna by this factor is possible.

EP 0 790 662 discloses, for example, an antenna structured in view of the above with a substrate and an L- or U-shaped radiant electrode and a power supply electrode. The radiant electrode is short-circuited with one end to a ground potential and is spaced by a gap from the power supply electrode at this end. The free end of the radiant electrode here has a distance from the supply electrode such that the two are electrically coupled by a capacitance formed by the gap. Due to the shape of radiant electrode and the manner of coupling, an antenna can be achieved with particularly small dimensions.

A further problem in connection with said integral applications arises in that multiband antennae are required for this which can be operated in each of the frequency bands used and must have a corresponding bandwidth. As the bandwidth of an antenna decreases as the dielectric constant of the substrate material rises, however, there is a particular minimum antenna size and hence a particular minimum size of circuit board on which the antenna is mounted if a required bandwidth is to be retained.

A general object of the invention is to find a possibility of further reducing the size of a printed circuit board which carries the essential electrical and/or electronic components for a communication device of the type mentioned above.

In particular, the invention is to provide a single or multiband antenna which allows further miniaturization of the printed circuit boards. Furthermore, a single or multiband antenna is to be created which in particular has an adequate bandwidth for use in one or more of the above frequency bands without requiring substantially greater dimensions.

Finally, a multiband antenna is to be created which is relatively easy to define as regards its resonant frequency.

The object is achieved as claimed in claim 1 with a printed circuit board for surface mounting of electrical and/or electronic components, in particular an SMD antenna with a ceramic substrate and at least one resonant conductor track structure, which is characterized in that the printed circuit board has a ground metallization substantially surrounding the antenna, and one end of the conductor track structure of the antenna is connected to the ground metallization.

A first advantage of this solution is that the ground metallization surrounding the antenna allows the other components of the circuit board to be arranged closer to the antenna, and hence the dimensions of the board can be reduced with the same number of components. The adaptation problems normally occurring due to ground metallization are largely avoided in that the track structure is connected not to a supply for electromagnetic waves to be emitted, but to the ground metallization.

This connection at the same time has the further advantage that an antenna with an essentially greater bandwidth can be achieved thereby without a substrate with a lower dielectric constant having to be used. The dimensions of the antenna consequently need not be enlarged in comparison with a relatively narrow-band antenna or are smaller than in a conventional antenna with the same bandwidth.

The object is also achieved in accordance with claim 1 with an SMD antenna with a ceramic substrate with at least one resonant conductor track structure which is characterized by a first supply lead for connecting one end of a first resonant track structure of the antenna to a ground potential and a second supply lead for coupling an electromagnetic wave to be emitted into the antenna, wherein the first conductor track structure has a plurality of conductor sections and where the length of the conductor track structure is suitable for exciting a desired first resonant frequency (base mode), and the course and distance of the conductor sections is chosen such that a first harmonic of the base mode can be excited.

In addition to the above advantages, this solution has the further advantage that a dual band antenna can be implemented in this relatively simple manner.

The dependent claims relate to further advantageous embodiments of the invention.

With the design as claimed in claim 1, a three-band antenna can be produced which is suitable in particular in the integrated communication devices of the type mentioned in the opening paragraphs.

The design as claimed in claim 2 has the advantage that the excited antenna resonances are particularly pronounced, while with the design as claimed in claims 3–7 in particular an electrical adaptation of the antenna can be optimized.

The invention will be further described with reference to examples of embodiments as shown in the drawings to which however the invention is not restricted.

The antennas according to the invention have a ceramic substrate of an essentially cuboid block, the height of which is smaller by a factor of 3 to 10 than its length or width. The large upper and lower surfaces of the substrate 1 shown in the views in FIGS. 1 and 2 will thus be referred to as the first or upper, and the second or lower surface 10, 11, and the vertical faces perpendicular thereto (thickness of substrate) as the first to fourth side faces 12 to 15.

Instead of a block-like substrate, however, other geometric shapes may be used such as, for example, rectangular, round, triangular, or polygonal cylindrical forms each with or without cavities, on which resonant track structures with, for example, spiraling shapes are provided.

The substrates have a relative permittivity of $\in_r>1$ and/or a relative permeability of $\mu_r>1$. Typical materials are high-frequency resistant substrates with low losses and a low temperature dependency of the high frequency properties (NP0 or SL materials). Substrates may also be used with a relative permittivity and/or relative permeability which are/is adjusted as desired by embedding of a ceramic powder in a polymer matrix.

The track structures of the antennae are essentially made from electrically highly conductive materials such as, for example, silver, copper, gold, aluminum or a super conductor.

The antennas according to the invention are of the basic type of "printed wire antennas" in which one or more resonant track structures are applied on a substrate. In principle, these antennas are wire antennas which in contrast to microstrip conductor antennas have no metallic surfaces forming a reference potential on one side of the substrate.

Figure 1:
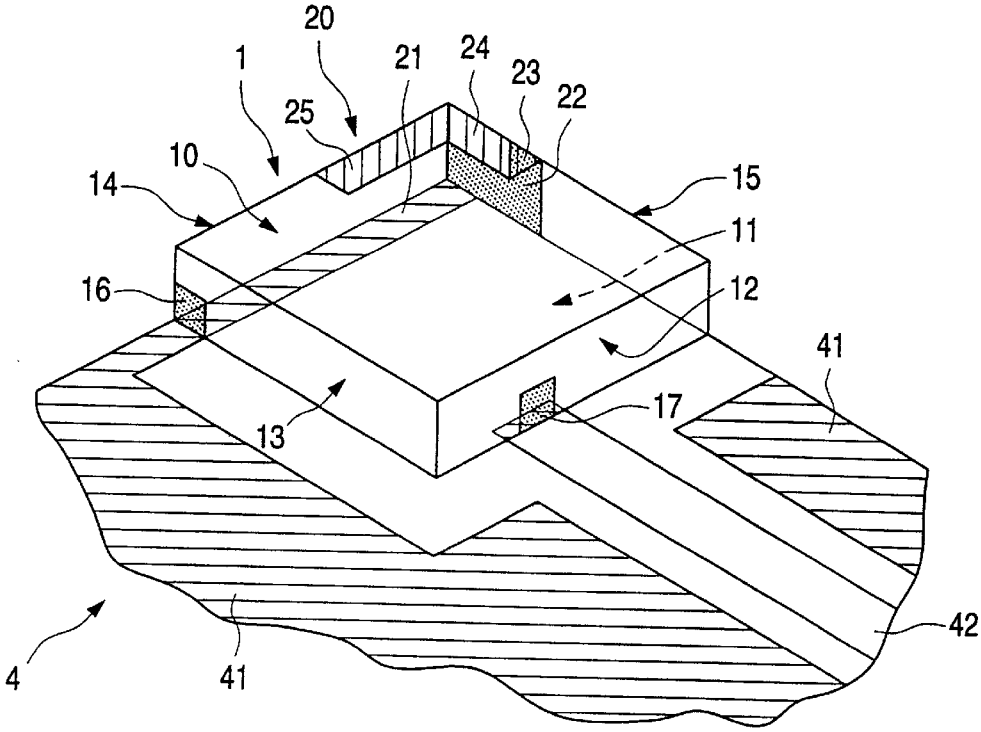
FIG. 1 is a diagrammatic view of a first embodiment of the antenna.

In detail, the antenna of FIG. 1 comprises a cuboid substrate 1, on the second side face 13 of which there is a first supply lead 16 and on the first side face 12 of which there is a second supply lead 17, each in the form of a metallization. The supply leads extend partly onto the lower surface 11 so as to make contact with a circuit board 4.

Furthermore, a first printed metal track structure 20, which begins with a first end at the first supply lead 16 and has a second open end on the substrate, lies on the surface of the substrate 1. The track structure 20 consists of a plurality of individual conductor sections which may each have a different width.

In the first embodiment according to FIG. 1, these are a first section 21 which begins at the first supply lead 16 and runs along the lower surface 11 at the edge of the third side face 14 to the fourth side face 15.

Then comes a second section 22 which extends horizontally along the fourth side face 15 up to a third section 23 extending vertically upwards. The third section 23 continues on the upper (first) surface 10 of the substrate as a fourth section 24 which extends along the edge of the fourth side face 15 as far as the third side face 14 and there merges into a fifth section 25 which runs on the first surface 10 along the edge of the third side face 14 and has a length which corresponds to approximately half the length of the third side face 14.

The antenna is soldered by surface mounting technology onto a circuit board 4 (shown in part). The first supply 16 lead is connected with a ground metallization 41 of the circuit board 4 largely surrounding the substrate 1, whereas the second supply 17 is soldered to a track 42 so as to feed in an electromagnetic wave to be emitted.

The frequency of the base mode may vary over the entire length of the track structure 20 and be set in the desired manner, which is still possible with the antenna in the incorporated state in that the length of the conductor track structure is shortened correspondingly, for example with a laser beam.

Substantial advantages of this embodiment are that a higher impedance bandwidth can be achieved than is possible with a printed wire antenna in which the resonant track structure extends in a usual manner from a signal conductor 42 of the circuit board. In particular, it is not necessary to use a substrate with a lower dielectric constant and hence accept larger dimensions.

The supply of the electromagnetic waves via the second supply lead 17 takes place capacitatively by scatter fields, where the coupling strength can be matched in a targeted manner to the antenna resonance via the distance of the second supply lead 17 from the conductor track structure 20. This is also possible in the incorporated state if the length of the second supply lead 17 on the first side face 12 is shortened accordingly, for example with a laser beam.

Furthermore, the described connection of the track structure to the first supply 16 allows the antenna to be surrounded almost immediately by the ground metallization 41 on a printed circuit board 4 without adaptation problems arising therefrom, as in the known antennas of this type. Firstly, the ground metallization 41 has a certain screening effect, and secondly the other elements of the circuit board can be arranged closer to the antenna so that the board can be made smaller or, for the same size, more space is available for other components or modules.

Figure 2:
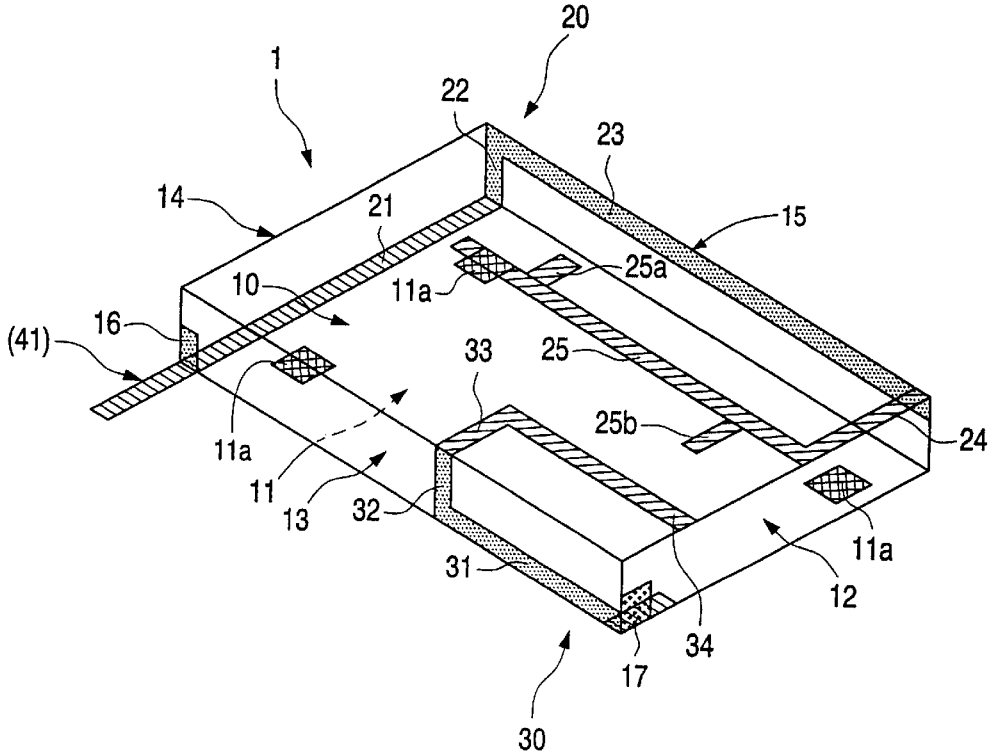
FIG. 2 is a diagrammatic view of a second embodiment of the antenna.

The second embodiment of the invention according to FIG. 2 is suitable for creating a multiband antenna which can be operated, for example, in all three mobile phone bands and/or other frequency bands mentioned above.

The circuit board 4 is not shown in this Figure. The antenna may, however, be soldered in the same way to such a board and surrounded with a ground metallization 41 in the manner described in connection with FIG. 1. The same advantages apply as with the first embodiment in this respect with this antenna again.

In view of the nature and shape of the substrate, the same applies as was explained with reference to the first embodiment. The substrate may also be attached to a board with one or more solder spots 11*a*.

The antenna has a first supply lead 16 to be connected to a ground metallization on the second side face 13 in the area of the edge of the third side face 14, and a second supply lead 17 to be connected to a supply line for electromagnetic waves to be emitted at the first side face 12 in the area of the edge of the second side face 13. The supplies (metallization) extend again partly onto the lower surface 11 in order to make contact with a circuit board.

A first track structure 20 issues from the first supply lead 16, starting with a first end at the first supply lead 16 and having a second, open end on the substrate. A second track structure 30 begins with a first end at the second supply lead 17 and has a second, open end on the substrate. The individual sections of the first and second track structures 20, 30 may again have different widths.

The first track structure 20 begins at the first supply lead 16 with a first section 21 which extends on the lower surface 11 of the substrate 1 along the edge of the third side face 14 as far as the fourth side face 15 and there runs up as a second section 22 to the edge of the upper surface 10. The first track structure 20 continues at the fourth side face 15 with a third section 23 along the edge of the upper surface 10 as far as the first side face 12. Then follows a fourth section 24 on the upper surface 10 which runs along the edge of the first side face 12 with a length of approximately one-third of the length of this side face. The first track structure 20 finally ends with a fifth section 25 which on the upper surface 10 connects essentially at right angles to the fourth section 24 and has a first and a second tuning stub 25*a*, 25*b*.

The second track structure 30 begins at the second supply lead 17 with a first section 31 which extends at the second side face 13 at the edge of the lower surface 11 up to approximately one-third of the length of the second side face 13. (This section 31 could also lie on the lower surface 11 at the edge of the second side face 13.) Then comes a second section 32 which runs up perpendicularly thereto to the upper surface 10 and merges into a third section 33 on the upper surface 10 perpendicular to the second side face 13. The second track structure 30 ends with a fourth section 34 which extends back parallel to the second side face 13 on the upper surface 11 as far as the edge of the first side face 12.

The antenna resonances are thus excited by a combination of capacitative and resonant coupling via the second supply 17 lead.

Figure 3:
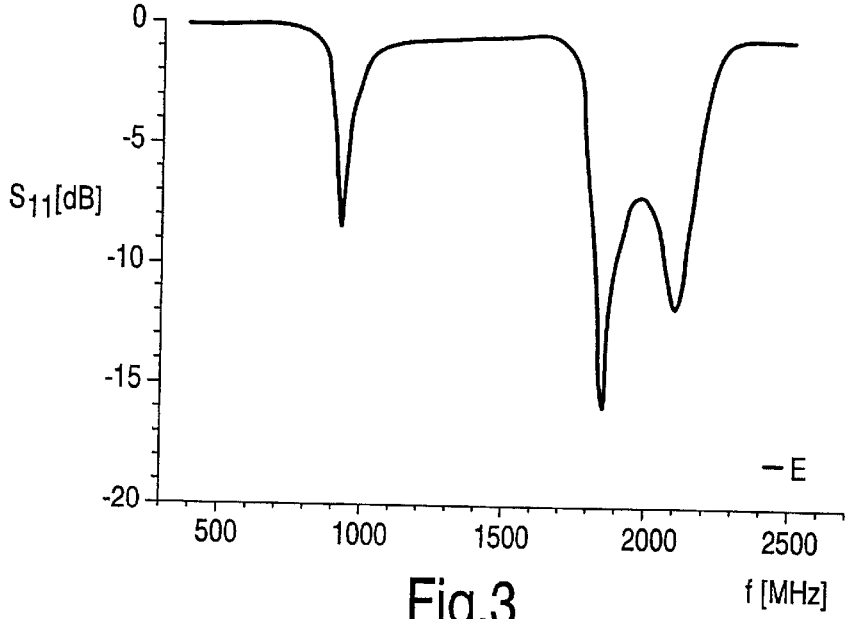
FIG. 3 shows an impedance spectrum of the antenna according to FIG. 2.

An impedance spectrum measured with this antenna is shown in FIG. 3, in which three resonant frequencies can clearly be distinguished at approximately 900, 1850 and 2100 MHz.

The position of the first resonant frequency, in this case the lower, is determined essentially by the length of the first track structure 20 starting from the first supply lead 16 and is given by its base mode, whereas the position of the second, in this case the central resonant frequency is essentially defined by the length of the second conductor track structure starting from the second supply 17 lead.

To operate the antenna at the third, in this case the upper resonant frequency, finally, the first harmonic of the first track structure 20 is excited, the position (frequency position) of which is set to a particular value by changing the coupling between the third and fifth sections 23, 25 of the first track structure 20 and hence by the length of the first tuning stub 25*a*.

Changing the length of the second tuning stub 25*b* achieves the coupling between the first and second track structures 20, 30 and hence the adaptation of the two upper resonant frequencies. The lengths of the tuning stubs 25*a*, 25*b* and the lengths of the first and second conductor track structures 20, 30 may also be reduced with the antenna in the incorporated state, for example by a laser beam, so that an adaptation is possible to a particular mounting and operating situation.

Where a dual band antenna is required which operates, for example, in the lower and upper mobile phone bands (GSM900 and DCS 1800 or PCS 1900), this can be achieved by omitting the second track structure 30, while the electromagnetic waves to be emitted are again coupled in via the second supply lead 17.

Finally, it should be stated that the antennas described here may be used in the same way for receiving.

What is claimed is:

1. A printed circuit board for surface mounting of electrical components including a surface mounted device antenna with a ceramic substrate and at least one resonant conductor track structure, the printed circuit board comprising a ground metallization configured to substantially surround the antenna, and to connect to one end of the conductor track structure, the antenna comprising a first supply lead configured to connect one end of a first resonant track structure of the antenna to a ground potential and a second supply lead configured to couple an electromagnetic wave to be emitted into the antenna, which first track structure has a plurality of conductor sections, while the length of the conductor track structure is dimensioned so as to excite a desired first resonant frequency, and the paths and spacings of the conductor sections are configured to excite a first harmonic of the first resonant frequency, and a second resonant track structure, one end of which is connected to the second supply lead and the length of which is configured dimensionally to excite at least one of a desired second resonant frequency and a harmonic of the second resonant frequency.

2. An antenna as claimed in claim 1, wherein the spacing between the first and second track structures is configured such that the resonant frequencies of the antenna are excited by a combined capacitive and resonant coupling of the electromagnetic wave to be emitted.

3. An antenna as claimed in claim 1, wherein the first track structure has conductor sections of different widths.

4. An antenna as claimed in claim 1, wherein at least one of the first and second track structure has conductor sections of different widths.

5. A telecommunications device with a printed circuit board as claimed in claim 1.

6. A telecommunications device with an antenna as claimed in claim 1.

7. A telecommunications device with an antenna as claimed in claim 1, wherein the antenna is a printed wire antenna.

* * * * *